US005727874A

United States Patent [19]

Yamamoto et al.

[11] Patent Number: 5,727,874

[45] Date of Patent: Mar. 17, 1998

[54] VEHICLE LAMP

[75] Inventors: Norimasa Yamamoto; Masahiro Maeda, both of Shizuoka, Japan

[73] Assignee: Koito Manufacturing Co., Ltd., Tokyo, Japan

[21] Appl. No.: 686,521

[22] Filed: Jul. 26, 1996

[30] Foreign Application Priority Data

Jul. 28, 1995 [JP] Japan ..... 7-212398

[51] Int. Cl.[6] ..... F21V 7/06

[52] U.S. Cl. ..... 362/305; 362/61; 362/309; 362/346; 362/348

[58] Field of Search ..... 362/61, 80, 215, 362/297, 304, 305, 308, 309, 332, 326, 346, 348

[56] References Cited

U.S. PATENT DOCUMENTS

| | | | |
|---|---|---|---|
| 1,903,417 | 4/1933 | Grant | 362/297 |
| 4,417,300 | 11/1983 | Bodmer | 362/304 |
| 4,459,647 | 7/1984 | Yamauchi et al. | 362/297 |
| 4,530,042 | 7/1985 | Cibie et al. | 362/309 |
| 4,779,179 | 10/1988 | Oyama et al. | 362/346 |
| 4,864,476 | 9/1989 | Lemons et al. | 362/348 |
| 4,972,307 | 11/1990 | Takatsuji et al. | 362/309 |
| 5,034,867 | 7/1991 | Mayer | 362/297 |
| 5,079,677 | 1/1992 | Kumagai | 362/61 |
| 5,406,464 | 4/1995 | Saito | 362/61 |

FOREIGN PATENT DOCUMENTS

| | | |
|---|---|---|
| 334891 | 9/1930 | United Kingdom . |
| 435946 | 10/1935 | United Kingdom . |
| 2 187 834 | 9/1987 | United Kingdom . |
| 2 262 980 | 7/1993 | United Kingdom . |
| 2 295 004 | 5/1996 | United Kingdom . |

*Primary Examiner*—Alan Cariaso

*Attorney, Agent, or Firm*—Sughrue, Mion, Zinn, Macpeak & Seas, PLLC

[57] ABSTRACT

A vehicle lamp includes a reflection mirror, a front lens, and a light source arranged between the reflection mirror and the front lens in such a manner that the central axis of the light source is perpendicular to the principal optical axis. The reflection mirror is composed of a reflection surface having a large number of reflection steps which are defined by portions of paraboloids of revolution and are disposed between adjacent ones of lines of intersection obtained between a group of the paraboloids of revolution having different focal distances and a fundamental reflection surface of the reflection surface. Each reflection step is arranged to be extended substantially in the vertical direction, and square lens steps are formed on the front lens. Due to the foregoing, an arrangement tendency with respect to a set of projected images of the light source formed by the reflection step is matched with a section of the lens step on the front lens.

12 Claims, 10 Drawing Sheets

VEHICLE LAMP

BACKGROUND OF THE INVENTION

The present invention relates to a vehicle lamp such as a tail lamp, a stop lamp and a turn signal lamp, in which a tendency of the arrangement of a projected image of a light source that has been projected in front of a reflection mirror by substantially longitudinal stripe-shaped reflection steps formed oh a reflection surface of the reflection mirror, is matched with the sections of square lens steps formed on a front lens arranged in front of the reflection mirror.

In order to enhance the aerodynamic characteristics and the design of automobiles, the recent styles in automobiles are tend to favor designs that rounded and streamlined. Therefore, the shapes of vehicle lamps are curved so that they are suitable for the preferred outlines of modern automobile bodies, or alternatively the shapes of vehicle lamps are inclined in the upward and downward direction. That is, there is a tendency that the shapes of vehicle lamps are slanted.

Due to the foregoing, the reflection surface of a reflection mirror is affected by a vehicle shape. Accordingly, it becomes impossible to use the more typical shape for lamp reflection surfaces such as a single paraboloid of revolution.

As the front lens arranged in front of the reflection mirror is slanted, it becomes necessary to assign the light distributing function, which is conventionally imposed on the front lens, to the reflection mirror. Therefore, the shape of the reflection surface has been improved by adopting a multi-reflection surface on which a plurality of paraboloids of revolution are combined with each other, or a plurality of minute reflection surfaces are assembled.

For example, in the case of a reflection mirror disclosed in GB 2262980, the reflection surface of the reflection mirror is composed of multi-loop-shaped reflection steps formed around the principal optical axis. This type reflection surface of the reflection mirror is formed as follows. First, a fundamental surface of the reflection surface is made as a free curved surface. When the reflection steps are formed on the fundamental surface, each surface of the reflection step is formed in such a manner that a tangential vector on the minute reflection surface at the reflection point on the reflection step coincides with an outer product of a normal line vector on the minute reflection surface at the reflection point and a normal line vector on the tangential plane of the fundamental surface at the reflection point. In this connection, a group of closed curves, which are used as a reference in the formation of the reflection steps, can be obtained as follows. A reference line is set on the fundamental surface of the reflection surface. A plurality of reflection points are designated on the reference line. According to the law of reflection, a minute reflection surface at the point concerned is found so that a ray of incident light directed from the light source to the reflection point can be made to be parallel with the optical axis after the reflection at the point concerned. A vector computed as an outer product of a normal line vector on the minute reflection surface at the reflection point and a normal line vector on the fundamental surface at the reflection point, is adopted as a directional vector to determine a direction of the formation of the reflection step. A closed curve is generated by means of spline approximation in which the directional vectors at a plurality of reflection points around the optical axis are used as tangential vectors. In this way, a group of closed curves can be obtained as a set of closed curves at an arbitrary reflection point.

In this connection, in the vehicle lamp in which the above reflection mirror is used, it is necessary that the sections of the lens steps formed on the front lens should be matched with a projected pattern, which comprises a set of projected images of the light source formed by the reflection steps of the reflection mirror. Therefore, it is very difficult to control rays of light in the lens steps. Further, there is caused a problem that the vehicle lamp does not look attractive when it is seen from the front lens to the reflection mirror during the lighting of the lamp.

In the above reflection mirror, under the condition that the principal optical axis always passes through the center of a group of the closed curves, the closed curves are formed around the principal axis like a shape of finger print, and each reflection step is formed along each closed curve. Accordingly, on the assumption that the ideal shape of the filament of a light bulb is columnar, when a large number of reflection points are set on one of the reflection steps and rays of light are traced with respect to projected images, axes of the projected images in the longitudinal direction are not arranged in order.

Due to the foregoing, the projection pattern, which is a set of projected images of the light source, becomes circular. Accordingly, it is necessary to design the shapes of the steps of the front lens so that they can be fitted to the circular projected patterns. Therefore, it takes time and labor to design the lens steps.

For example, only when the front lens is divided into small grid-shaped sections and a fish-eye lens is formed in each grid section, the shape of the projection pattern is not matched with the lens steps, the shapes of which are square when they are seen from the front of the vehicle lamp. This causes a problem in which the shapes of the reflection steps are conspicuous in the case of false lighting caused by outer light. In order to solve the above problem, it is necessary to attach an inner lens between the front lens and the reflection mirror.

SUMMARY OF THE INVENTION

The present invention is to provide a vehicle lamp comprising: a reflection mirror having a reflection surface composed of a large number of reflection steps which are defined by portions of the respective paraboloids of revolution and are formed between adjacent ones of lines of intersection, the lines of intersection being obtained between a group of paraboloids of revolution having different focal distances and a fundamental reflection surface; a front lens arranged in front of the reflection mirror; and a light source arranged on a principal optical axis of the reflection mirror so that a central axis of the light source is arranged to be perpendicular to the principal optical axis of the reflection mirror, wherein the reflection steps are formed into longitudinal stripe-shapes in the vertical direction when a view is taken in the direction along the principal optical axis of the reflection mirror, and the lens steps are also formed in square regions on the front lens. Consequently, according to the present invention, the reflection steps are formed into a longitudinal stripe-shape in the substantial vertical direction, and a shape of the projection pattern formed as a set of projection images of the light source from one reflection step extends in the horizontal or vertical direction. Accordingly, the shape of the projection pattern is matched with the square section of the lens step formed on the front lens.

BRIEF DESCRIPTION OF THE DRAWINGS

FIG. 2 is a front view showing an outer frame, wherein FIG. 2 shows together with FIGS. 3 to 6 a method of forming a fundamental surface of the reflection surface according to the present invention;

FIG. 7 is a view showing a fundamental surface and a group of lines of intersection obtained between the fundamental surface and a group of paraboloids of revolution, wherein FIG. 7 shows together with FIGS. 8 and 9 a method of forming a reflection surface of the present invention;

FIG. 12 is a front view of the vehicle lamp, wherein FIG. 12 shows together with FIG. 13 an example of the vehicle lamp according to the present invention.

DETAILED DESCRIPTION OF THE INVENTION

The vehicle lamp of the present invention will be described as follows.

Figure 1:
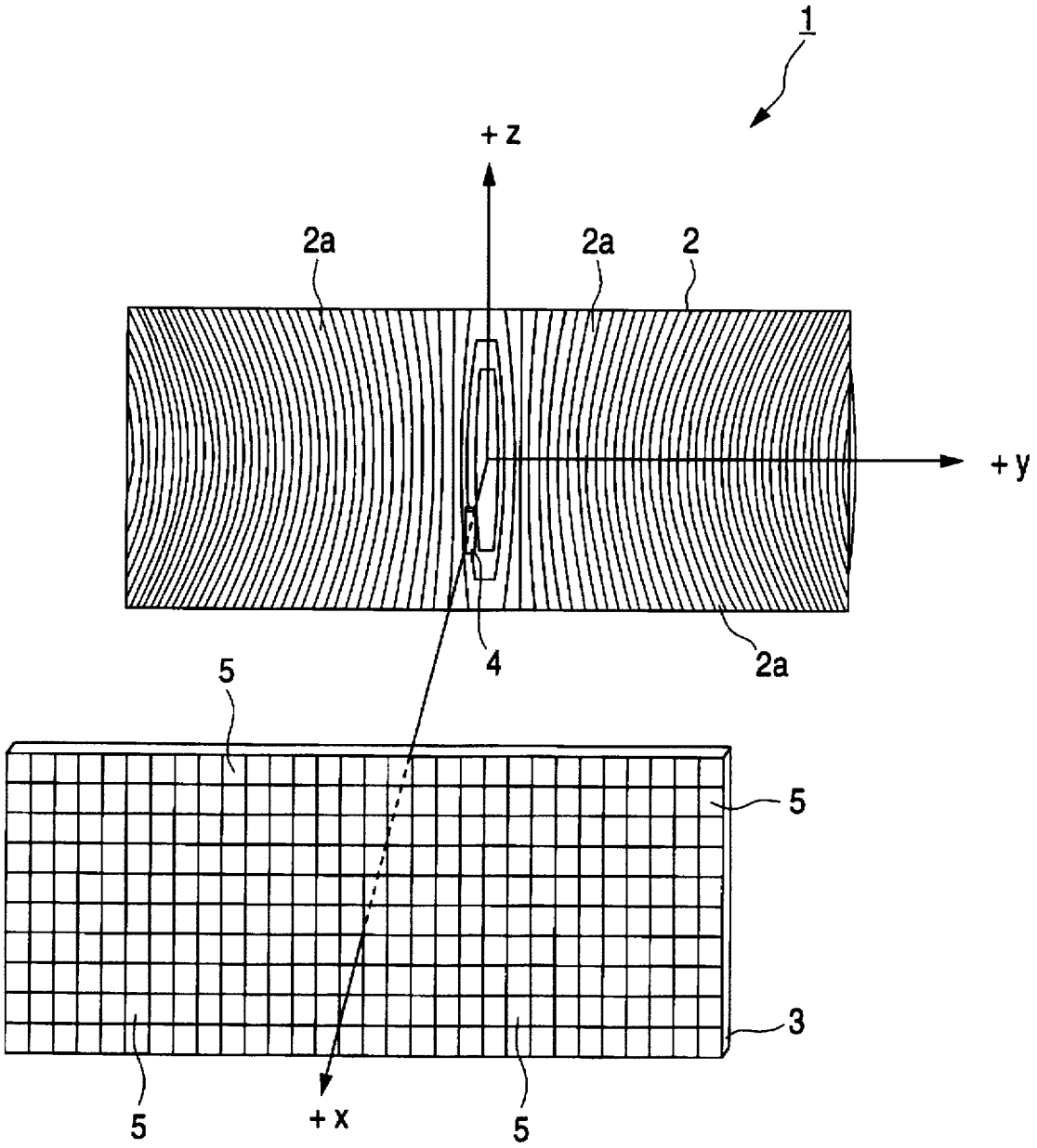
FIG. 1 is a schematic perspective view showing an arrangement of the vehicle lamp according to the present invention.

As schematically shown in FIG. 1, a vehicle lamp 1 is composed of a reflection mirror 2 and a front lens 3 arranged in front of the reflection mirror 2. In this connection, the x-axis shown in FIG. 1 represents a principal optical axis of the reflection mirror 2, the y-axis represents a horizontal axis perpendicular to the x-axis, and the z-axis represents a vertical axis perpendicular to the x-axis and the y-axis.

On the reflection mirror 2, there are formed longitudinal stripe-shaped reflection steps 2*a* which vertically extend in the direction of the y-axis.

In front of the reflection mirror 2, there is provided a vehicle light source 4 on the x-axis, which is composed of a filament of a light bulb or an arc of an electric discharge lamp. On the front lens 3 arranged in front of the light source 4, lens steps are respectively formed in the regions that are divided into substantial squares when they are seen from the front of the vehicle lamp. In this connection, in the drawing, the shape of the lens step is a substantial grid-shape, however, it should be noted that the shape of the lens step is not limited to the specific embodiment, but the shape of the lens step may be formed into a rectangle which is long either in the longitudinal direction or the transverse direction. The important thing is to provide a lens step in a region which is formed into a substantial square when a view is taken from the front side. The outer shape of the reflection mirror 2 or the front lens 3 is not limited to a square, but it may be circular or round.

A method of forming the reflection mirror 2 will be explained below. In this case, the explanation is made in two stages, one is a stage in which a fundamental surface of the reflection surface is formed, and the other is a stage in which the reflection steps are formed on the fundamental surface.

FIGS. 2 to 6 are views showing a procedure of forming the fundamental surface of the reflection surface.

(a1) An outer frame of the reflection surface is set.

Figure 2:
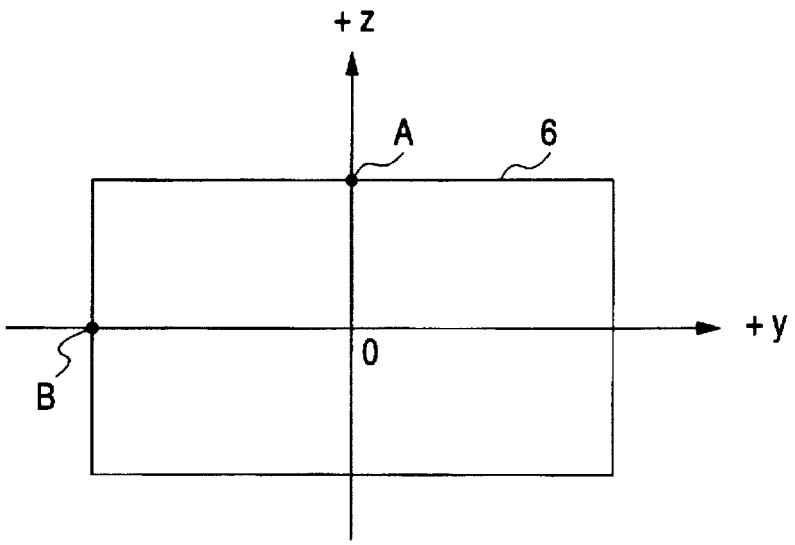

First, as shown in FIG. 2, an outer frame 6 is determined which is an outline of the reflection surface when a view is taken from the front, that is, when a view is taken in the direction of the x-axis. In this case, the outer frame 6 is formed into a rectangle, the transverse side of which is longer than the longitudinal side. However, it should be noted that any shape may be adopted as long as the shape is on one plane. In this connection, point A in the drawing is a middle point of the upper side of the outer frame 6, that is, point A is an upper crossing point at which the outer frame 6 crosses the x–z plane, and point B is a middle point of the left side of the outer frame 6, that is, point B is a left crossing point at which the outer frame 6 crosses the x–y plane.

(a2) The depth of the reflection surface is determined.

Figure 3:
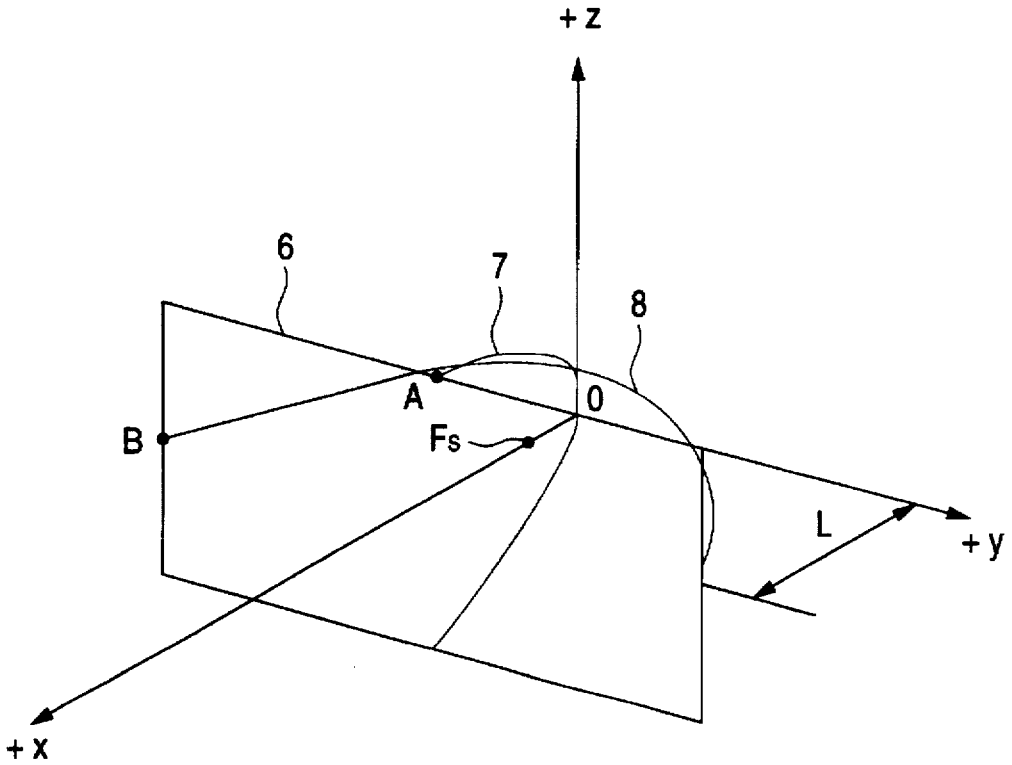
FIG. 3 is a perspective view showing an outer frame and a reference parabola.

As shown in FIG. 3, the length L of the reflection surface in the direction of the x-axis is determined.

(a3) A reference parabola passing through the point A, the focus of which is Fs, is described on the vertical surface.

As shown in FIG. 3, on the vertical surface on which point A is located, a reference parabola 7 passing through point A, the focus of which is Fs, is described.

(a4) A reference parabola passing through the point B, the focus of which is Fs, is described on a horizontal plane.

As shown in FIG. 3, on the horizontal surface on which point B is located, a reference parabola 8 passing through point B, the focus of which is Fs, is described.

(a5) In accordance with the reference parabola 8, "a multi-reflection line" is formed.

"The multi-reflection line" defined here is a compound curve formed in such a manner that portions of the parabolas belonging to the group of parabolas, the focal distances of which are different from each other, are successively connected in accordance with a predetermined rule.

Figure 4:
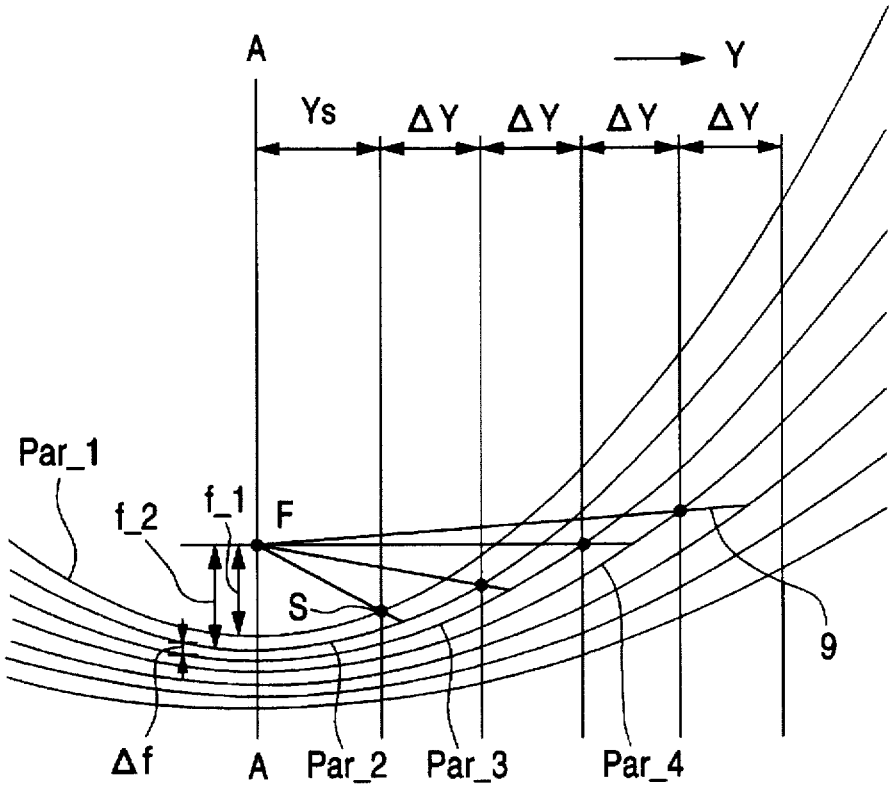
FIG. 4 is a view to explain the formation of multi-reflection lines.
Figure 5:
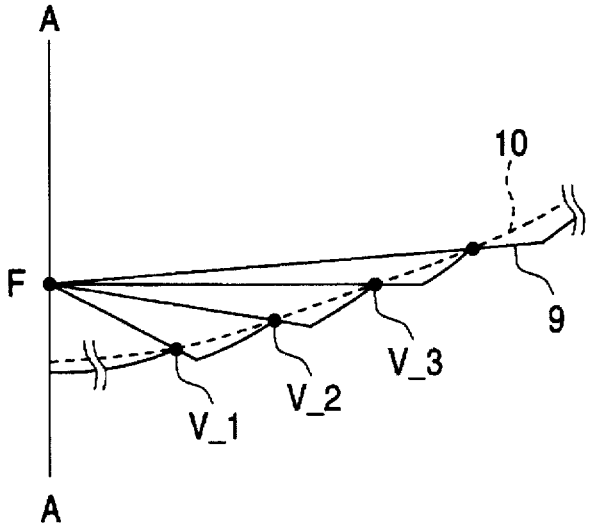
FIG. 5 is a view to explain a method of forming a spline curve for the multi-reflection lines.

FIGS. 4 and 5 are views for explaining a method of forming the multi-reflection line. The parabolas par_i (i=1, 2, . . . ) composing a group of parabolas have the same focus point F, and the focal distances of the parabolas par_i are different from each other. In this connection, the above reference parabola 8 is utilized as a reference line when the group of parabolas are generated.

The Y-axis shown in the drawing extends in a direction perpendicular to the common axis A—A of the group of parabolas which passes through the focus F. The point S on the parabola par_1 located at the closest position to the focus F is the first changing point of the multi-reflection line. That is, a curved portion of the parabola par_1 in the range Ys is the first element of the multi-reflection line. Portions of the parabolas par_i (i=2, 3, . . . ) separated from each other by the step width ΔY in the direction of the Y-axis are successively connected with each other. In this connection, Δf shown in the drawing is an amount of change in the focal distance. Therefore, the more outside the parabola is located, the longer the focal distance is extended. The parabolas are connected in such a manner that each boundary point of the parabolas adjacent to each other is located on a straight line which passes through the focus F.

As described above, the shape and connection of the curve is controlled by the four parameters of f_1, Δf, Ys and ΔY, and the multi-reflection line 9 is formed as a compound curve having a number of joints by which the group of parabolas are partially connected. In this connection, in the example shown in FIGS. 4 and 5, the group of parabolas have a common focus. However, in general, the actual light source is not a point light source, but it is a light source having a certain range. Accordingly, the focus of the group of the parabolas can be distributed into certain range.

(a6) A spline curve is described which passes through each top of the multi-reflection line 9.

As can be seen in the above forming method, the multi-reflection line 9 is a compound curve having protrusions and recesses. In order to obtain a smooth curve according to the multi-reflection line 9, as shown by a broken line in FIG. 5, a spline curve 10 is formed which passes through the tops V_i (i=1, 2, . . . ) on the projection side of the multi-reflection line 9.

(a7) A reference surface is formed in accordance with the outer frame 6 and the spline curve 10.

Figure 6:
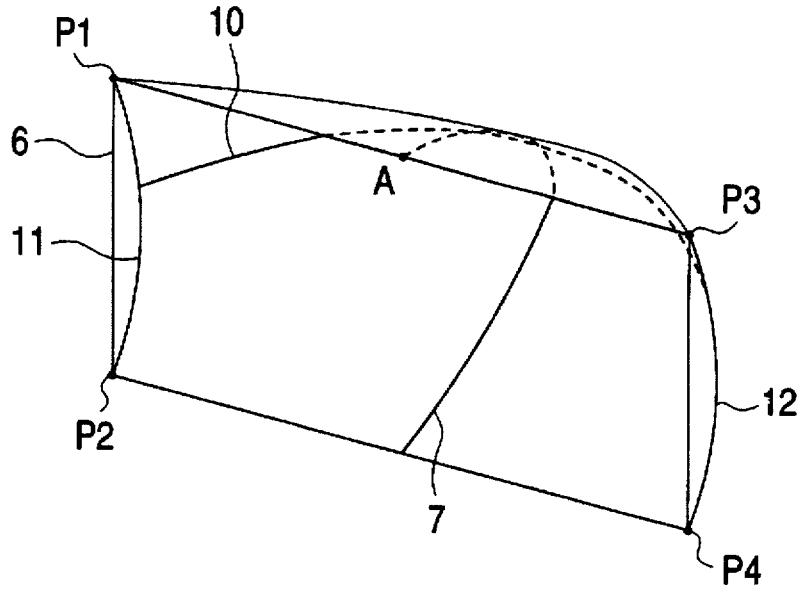
FIG. 6 is a view showing a curved surface formed in accordance with the outer frame, the reference parabola and the spline curve in which FIG. 6(*a*) is a view showing a case in which an end portion of the spline curve is not on the outer frame, and FIG. 6(*b*) is a view showing a case in which an end portion of the spline curve is on the outer frame.
Figure 6:
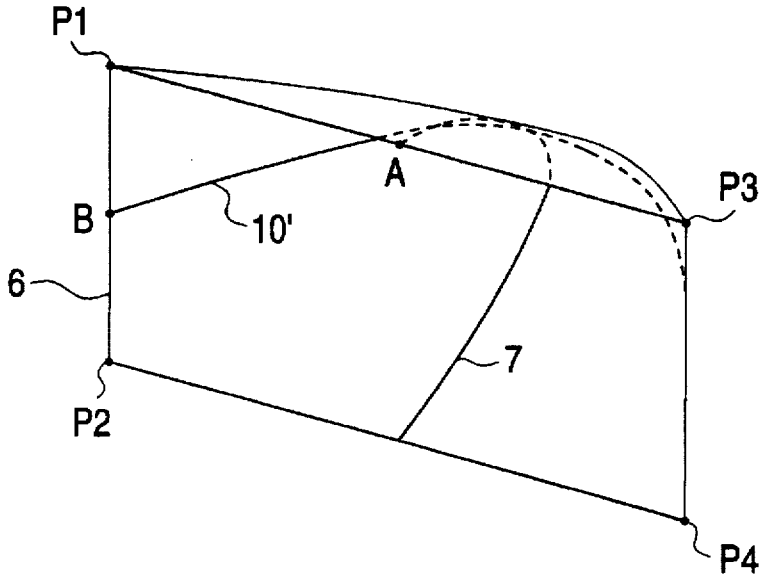

The length of the reference parabola 7 in the vertical direction in the above item (a3) is defined by the upper frame and the lower one of the outer frame 6, and curves 11, 12 shown in FIG. 6(*a*) are obtained by the spline curve 10 of the item (a6) and the right and left frames of the outer frame 6. That is, the curve 11 is a spline curve which passes through the left upper point P1 and the left lower point P2 of the outer frame 6 and also passes through the left end point of the spline curve 10. The curve 12 is a spline curve which passes through the right upper point P3 and the right lower point P4 of the outer frame 6 and also passes through the right end point of the spline curve Lo. These curves 11, 12, the reference parabola 7 and the spline curve Lo generate a spline curved-surface, by which the fundamental surface is formed.

In this connection, FIG. 6(*a*) shows a case in which the right and left end points of the spline curve Lo and the four corner points of the outer frame 6 are not located on the same straight line. In the above case, flat portions are formed in the right and left peripheral edges of the curved surface. However, as shown in FIG. 6(*b*), it is possible to arrange the end points of the spline curve on the right and left frame lines of the outer frame 6. That is, it is possible to arrange the end points of the spline curve 10' on the outer frame 6 by appropriately selecting the formation parameters to form the reference parabola 8 and the multi-reflection line 9.

In the above explanation, the reference parabola 7 in the vertical direction is maintained as it is. However, if necessary, the curved surface may be formed as follows. A multi-reflection line is formed for the reference parabola 7. A spline curve to connect the tops of the multi-reflection line is obtained. The curved surface is formed in accordance with the spline curve Lo or 10' in the horizontal direction and the outer frame 6.

Next, referring to FIGS. 7 to 9, a procedure to form reflection steps on the above fundamental surface will be explained.

(b1) A fundamental surface is set.

Figure 7:
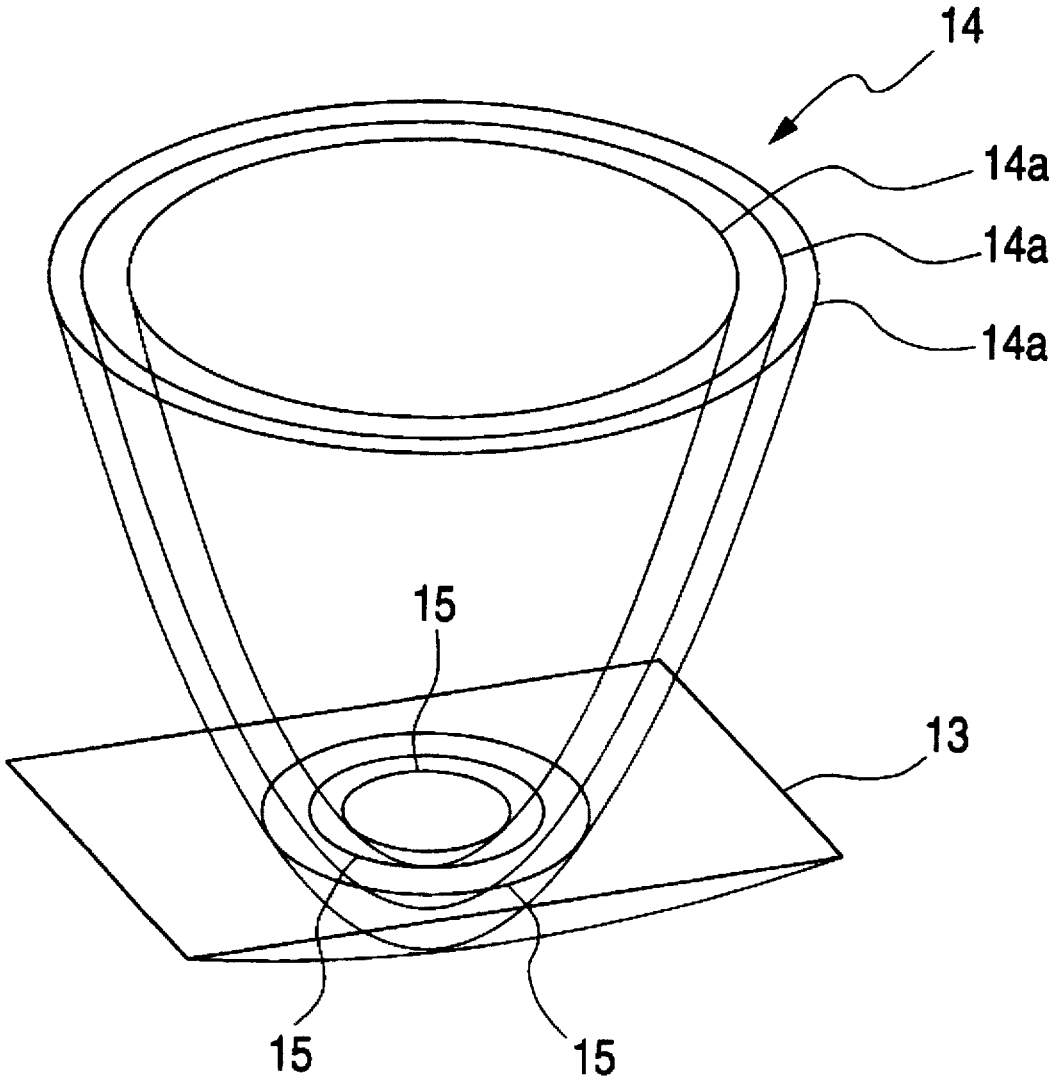
Figure 8:
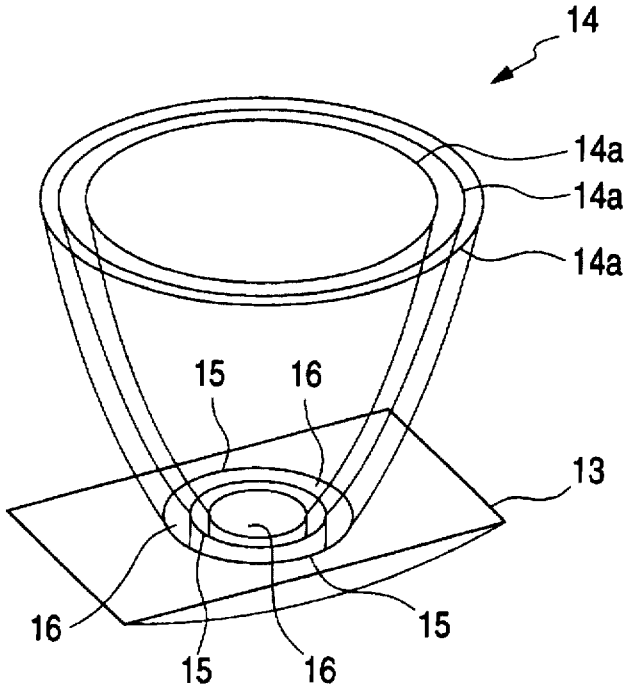
FIG. 8 is a view to explain the formation of the reflection steps provided along a group of lines of intersection.

The fundamental surface 13 designed by the above procedure is set as shown in FIG. 7.

(b2) A group of paraboloids of revolution are set.

With respect to the above fundamental surface 13, a group of paraboloids of revolution 14 to determine the light distribution performance of the reflection surface is prepared. This group of paraboloids of revolution 14 are composed of a large number of paraboloids of revolution 14*a* having a common symmetrical axis of revolution and different focal distances (the focal points of which are not necessarily the same with each other). In this connection, the paraboloids of revolution 14*a* are selected in such a manner that none of them specially cross each other.

(b3) Generation of a group of lines of intersection.

Lines of intersection 15 of the above fundamental surface 13 and the group of paraboloids of revolution 14 are determined. In this connection, none of these lines of intersection 15 cross each other.

(b4) Formation of reflection steps.

After the lines of intersection 15 have been determined, reflection steps are formed in accordance with the lines of intersection. As shown in FIG. 8, the reflection steps 16 are defined by portions of the respective paraboloids of revolution and are formed between adjacent ones of the lines of intersection.

Figure 9:
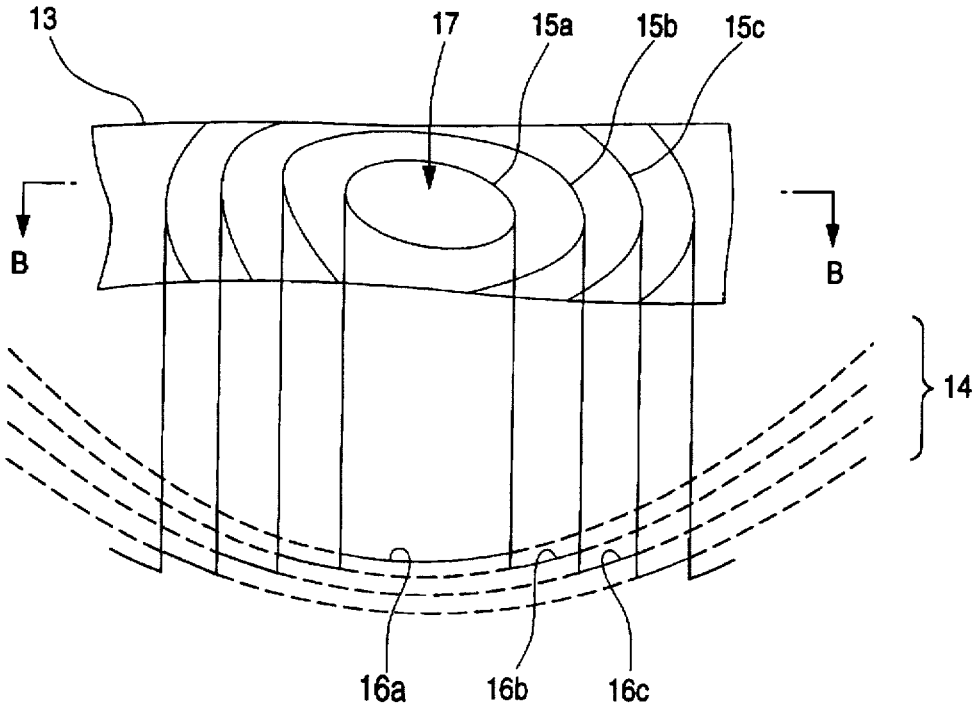
FIG. 9 is a schematic illustration showing a front shape and a cross-sectional shape of the reflection step.

In FIG. 9, a front view of the curved surface 13 is arranged in the upper row, and a schematic cross-sectional view taken on line B—B in the front view is arranged in the lower row. The lines of intersection on the curved surface 13 are successively denoted by the reference numerals 15*a*, 15*b*, 15*c*, . . . from the one close to the center 17 of the group of lines of intersection. These lines of intersection appear as the boundary lines of the reflection steps. In this connection, broken lines on the drawing represent the group of paraboloids of revolution 14. The reflection step 16*a* is formed in an inner region defined by the line of intersection 15*a*. The reflection step 16*b* is formed in an inner region between the lines of intersection 15*a*, 15*b*. The reflection step 16*c* is formed in an inner region between the lines of intersection 15*b*, 15*c*. In this way, the shapes of the reflection steps are determined. That is, the reflection surfaces of individual reflection steps are formed in such a manner that the reflection surfaces form the portions of the respective paraboloids of revolution. In this case, sections of the reflection surfaces of individual reflection steps are formed like a stair case.

A reflection mirror having the reflection surface provided with the above reflection steps formed in accordance with the multiplied lines of intersection is made by using a CAD (Computer Aided Design) system. Based on this, in order to make a metallic mold of the reflection mirror 2, it is possible to obtain the necessary data for by using a CAM (Computer Aided Manufacturing) system.

Figure 10:
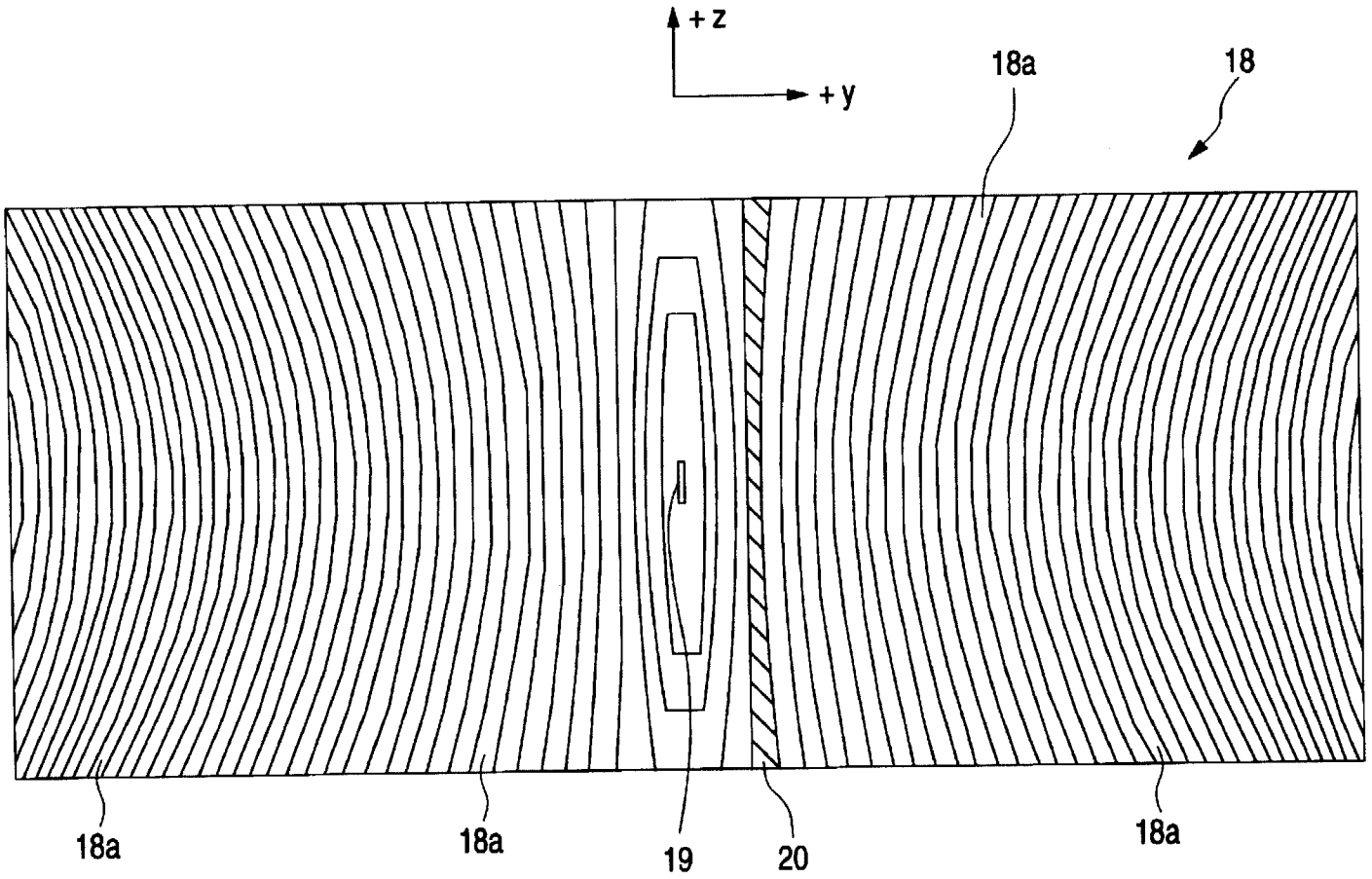
FIG. 10 is a front view showing an example of a group of lines of intersection on the reflection surface and the arrangement of the light source with respect to the reflection surface.

FIG. 10 is a view showing an example of the characteristics of the shape of the reflection surface formed by the above method. In this view, an example of the arrangement of the group of lines of intersection on the curved surface is shown.

As shown in the drawing, the lines of intersection 18*a* are arranged in substantial stripe-shapes. The group of lines of intersection 18 include lines of intersection curved outward in the transverse direction and lines of intersection curved inward on the contrary. There is a tendency that the radii of curvature of the lines of intersection are small in the middle on the curved surface and that the radii of curvature of the lines of intersection are gradually increased in both end portions.

Figure 11:
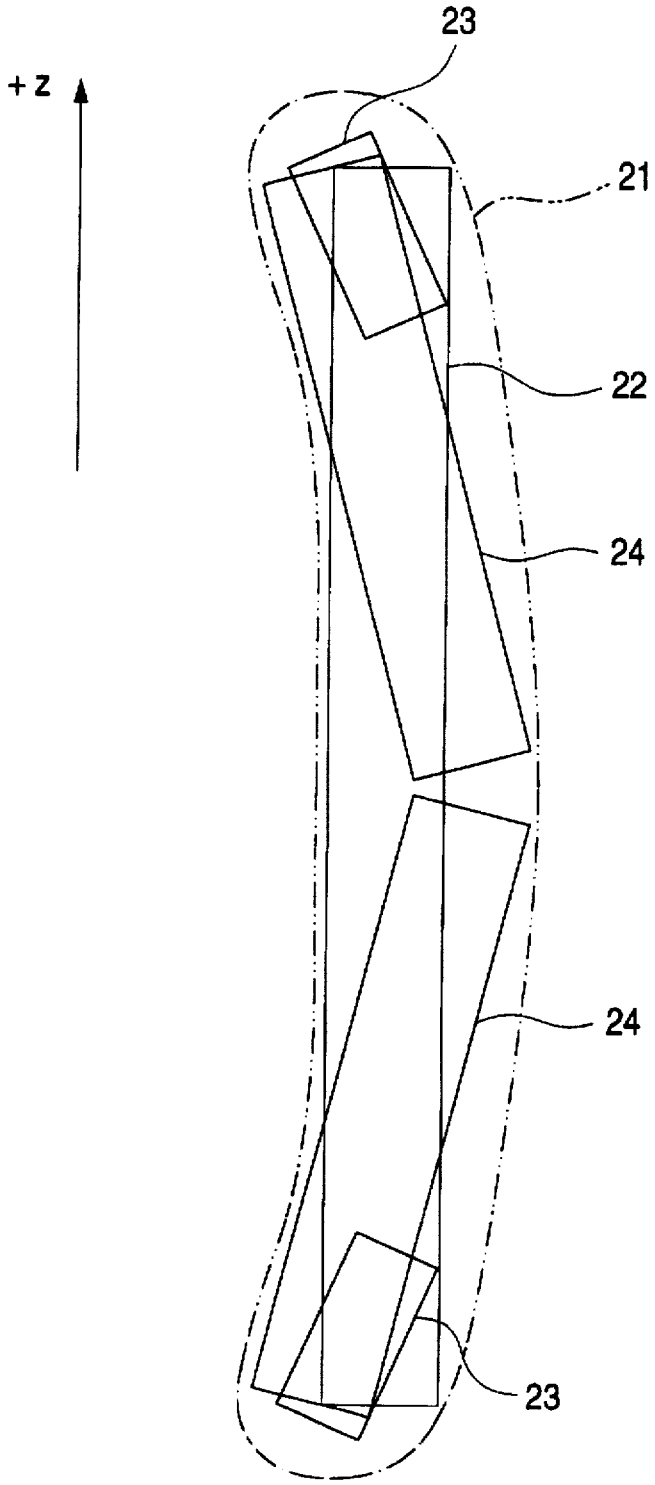
FIG. 11 is a schematic illustration to explain a projection pattern obtained by one reflection step on the reflection surface shown in FIG. 10.

FIG. 11 is a view showing a tendency of the image of the light source projected by several reflection points that have been set on one reflection step comprising the reflection surface of the reflection mirror.

In this case, it is assumed that the ideal shape of the filament 19 of the electric bulb of the light source 4 is columnar. As shown in FIG. 10, when a view is taken from the front of the filament 19, the central axis of the filament 19 is perpendicular to the x-axis and extends in the direction of the z-axis, and the center of the filament 19 is located on the x-axis.

As shown by a hatched portion in FIG. 10, the objective reflection step 20 is a portion located on the right of the filament 19 being a little separate when a view is taken from the front. When a large number of reflection points are set on the reflection step 20 concerned and a ray of light is traced with respect to each reflection point, a projection pattern 21 is obtained as a set of the filament images as shown in FIG. 11.

The filament images 22 to 24 define a portion of the filament image composing the projection pattern 21. The filament image 22, the projection area of which is large, is an image in the case of reflection in which a distance from the filament 19 to the reflection point is short. The filament images 23, 23, the projection areas of which are small, are images in the case of reflection in which a distance from the filament 19 to the reflection point is long. The filament images 24, 24 are images in the case of reflection in which a distance from the filament 19 to the reflection point is an intermediate value.

The central axis of the filament image 22 in the longitudinal direction extends in a substantial vertical direction. The central axes of the filament images 24, 24 in the longitudinal direction are inclined with respect to the central axis of the filament image 22 in the longitudinal direction. The filament images 23, 23 are located at the positions close to the end portions of the filament image 22 in the vertical direction.

The above filament image makes a projection pattern 21, the overall shape of which extends in the substantially vertical direction. The above projection pattern 21 is suitable for the lens steps 5 which are formed in the substantial square regions on the front lens 3. That is, the function to be given to the lens step is to diffuse the filament image in the longitudinal direction or the direction perpendicular to the longitudinal direction. Also, the function to be given to the lens step is to control the degree of the diffusion of the filament image. For example, when a fish-eye lens step is used for the lens step 5, it is possible to change the degree of diffusion in the horizontal direction and/or the vertical one of the projection pattern by controlling the radiuses of curvature on the horizontal section and the vertical one.

Since the shape of the projection pattern 21 is formed in line with the vertical direction and matched with the section of the lens step 5, it is possible to make the vehicle lamp look attractive when it is being turned on, without providing an inner lens.

Since the boundary lines of the reflection steps are arranged in line with the vertical direction being formed into a stripe-shape, when the vehicle lamp is not turned on, the boundary lines are matched with the lens steps 5 formed in the square regions on the front lens 3. When the lens steps are given an enlargement action so that the boundaries of the reflection steps can be seen in such a manner that they extend like straight lines in the substantially vertical direction by the action of the lens steps 5 when the reflection mirror 2 is seen from the front lens 3, it is possible to make the vehicle lamp look better.

Figure 12:
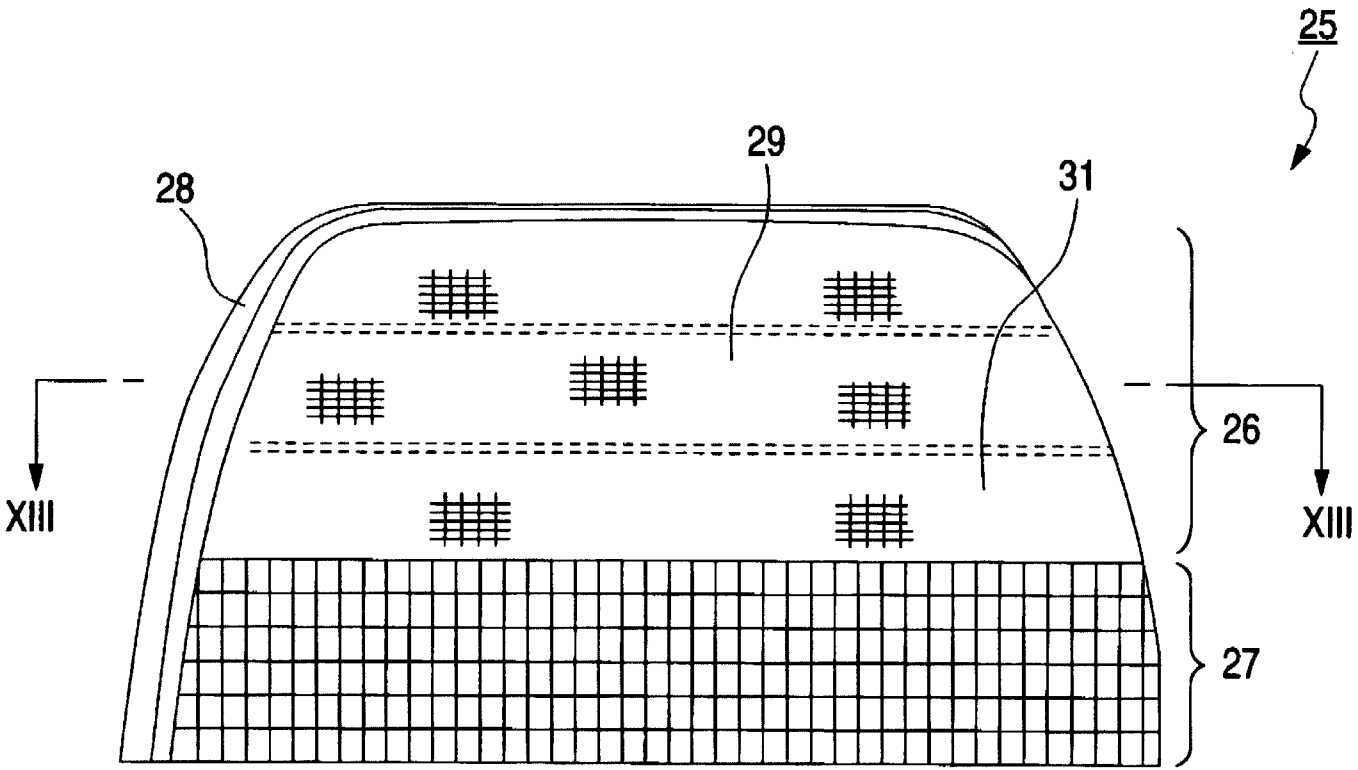
Figure 13:
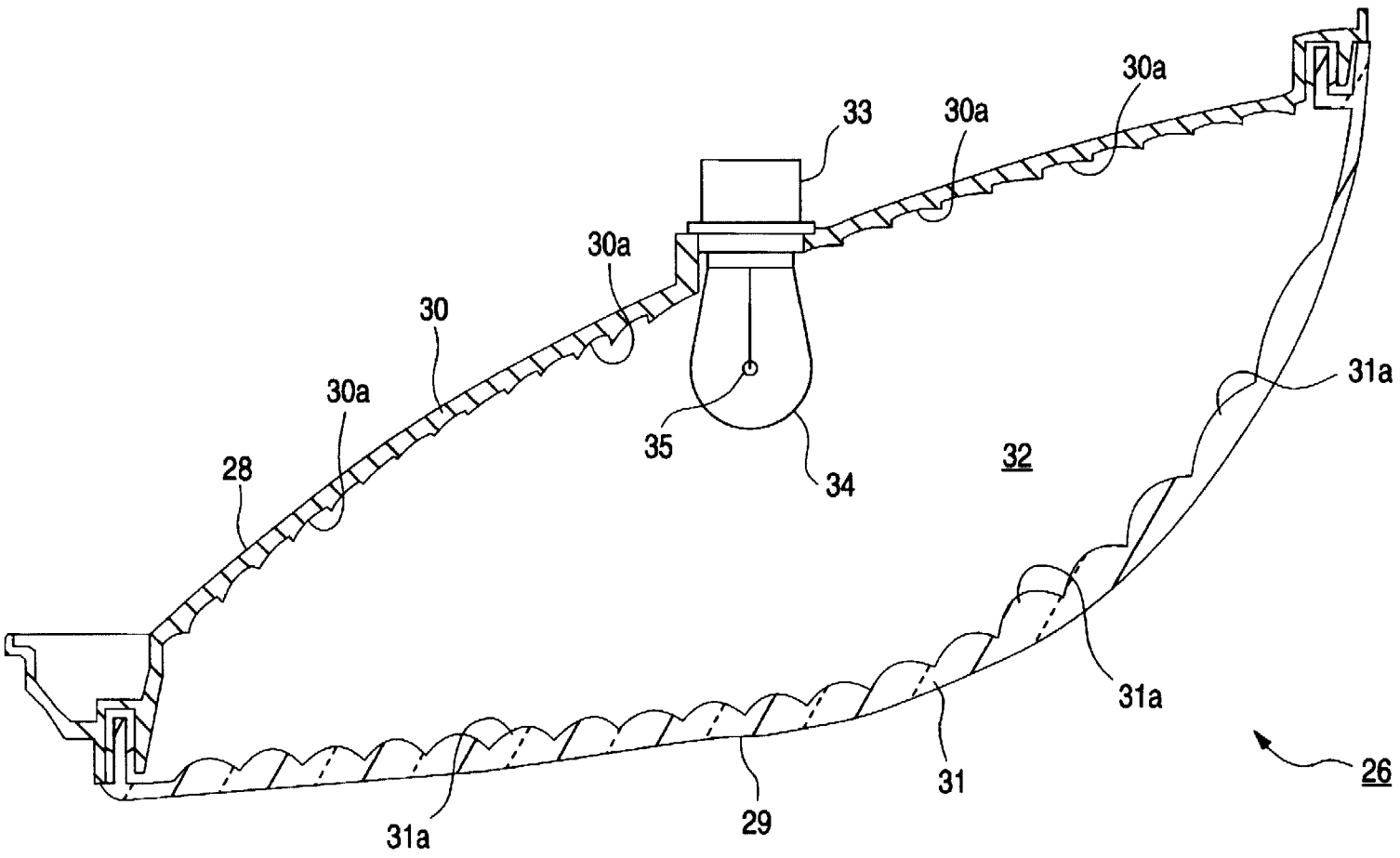
FIG. 13 is an enlarged cross-sectional view taken on line XIII—XIII in FIG. 12.

FIGS. 12 and 13 are views showing an example of the vehicle lamp according to the present invention. In this example, the vehicle lamp is applied to a rear combination lamp for automobile use.

As shown in FIG. 12, the vehicle lamp 25 intrudes: a tail and stop lamp portion 26 that occupies an upper portion, the area of which is about two thirds of the overall vehicle lamp; and a turn signal lamp portion 27 that occupies a lower portion, the area of which is about one third of the overall vehicle lamp.

A vehicle lamp space of the vehicle lamp 25 is defined by a lamp body 28 made of synthetic resin and a front lens 29 attached to the lamp body 28 in such a manner that the front lens 29 covers the front portion of the lamp body 28. In this case, the light illuminating direction is defined as a front direction. As described above, the vehicle lamp space is defined by the two parts.

In this example, the above arrangement of the vehicle lamp 1 is applied to a tail and stop lamp portion 26.

FIG. 13 is a view showing a horizontal cross-section of the tail and stop lamp portion 26. The vehicle lamp space 32 is defined by a reflection portion 30 composing a portion of the lamp body 28, and a lens portion 31 of the front lens 29 located in the front of the reflection portion 30.

A reflection surface of the reflection portion 30 is composed of the aforementioned stripe-shaped reflection steps **30*a***, which undergo a reflection treatment such as reflection coating or aluminum vapor-deposition. In this connection, a shape of the cross-section of the center of the reflection surface in the horizontal direction taken on a vertical surface including the principal optical axis of the reflection mirror, is parabolic. Therefore, the shape of the cross-section is symmetrical with respect to the horizontal surface including the principal optical axis of the reflection mirror.

The lens portion 31 is divided into a large number of grid-shaped regions when a view is taken from the front. There are provided fish-eye lenses **31*a*** in these grid-shaped regions.

An electric bulb 33 is attached to the reflection portion 30 by a means not shown in the drawing. A central axis of the filament 35 arranged in the glass bulb 34 is perpendicular to the principal optical axis of the reflection portion 30 and extends in the vertical direction.

As can be seen in the above explanations, according to the present invention, when a view is taken in the direction of the principal optical axis of the reflection mirror, the lens steps formed in the substantially square regions on the front lens are matched with the projected image of the light source formed by the reflection steps on the reflection mirror. Accordingly, only when lens steps of simple shapes are arranged on the front lens in orderly rows, without using additional parts such as an inner lens, rays of reflection light can be easily controlled. Further, when the reflection mirror is seen from the front lens, the vehicle lamp looks good.

What is claimed is:

1. A vehicle lamp comprising:

a reflection mirror having a principal optical axis and a reflection surface comprising a plurality of reflection steps, said steps being defined by portions of respective paraboloids of revolution and disposed between adjacent ones of lines of intersection, each said lines of intersection being obtained where a respective one of a group of said paraboloids of revolution having different focal distances meets a basic reflection surface;

a front lens arranged in front of said reflection mirror; and a light source arranged on said principal optical axis of said reflection mirror so that a central axis of said light source is arranged to be perpendicular to said principal optical axis of said reflection mirror;

wherein said reflection steps are formed into longitudinal stripe-shapes in the vertical direction, when viewed in the direction of said principal optical axis of said reflection mirror, and wherein said lens steps are also formed in square regions on said front lens.

2. A vehicle lamp as recited in claim 1, wherein said light source comprises a filament and said reflection steps project a plurality of filament images.

3. A vehicle lamp as recited in claim 2, wherein the projection of each said filament images varies in imerse relation to a distance of the filament to the reflection point.

4. A vehicle lamp as recited in claim 2, wherein at least one filament image has a central axis disposed in the longitudinal direction and at least one central axis of said images extends in a substantially vertical direction.

5. A vehicle lamp as recited in claim 4 wherein said central axis of said at least one filament image in the longitudinal direction is inclined with respect to the central axis of the filament image in the longitudinal direction.

6. A vehicle lamp as recited in claim 4 wherein said filament image in said longitudinal direction is disposed at a position close to an end portion of the filament image in the vertical direction.

7. A vehicle lamp as recited in claim 2, wherein the overall shape of said filament images form a projection pattern that extends in the substantially vertical direction.

8. A vehicle lamp as recited in claim 7, wherein said projection pattern is shaped to match said lens steps formed in the square regions on said front lens.

9. A vehicle lamp as recited in claim 2, wherein said lens step diffuses said filament image in one of a longitudinal direction and a direction perpendicular to said longitudinal direction.

10. A vehicle lamp as recited in claim 1, wherein a shape of the cross-section of the center of the reflection surface in the horizontal direction taken on a vertical surface including the principal optical axis of the reflection mirror, is parabolic.

11. A vehicle lamp as recited in claim 1, wherein said lens steps are assembled into a grid-shaped region when a view is taken from the front.

12. A vehicle lamp as recited in claim 8 wherein a plurality of said grid-shaped regions comprise fish-eye lenses.

* * * * *